United States Patent [19]

Viessmann

[11] Patent Number: 4,652,236

[45] Date of Patent: Mar. 24, 1987

[54] ATMOSPHERIC GAS BURNER ASSEMBLY

[76] Inventor: Hans Viessmann, Im Hain, D-3559 Battenberg/Eder, Fed. Rep. of Germany

[21] Appl. No.: 838,144

[22] Filed: Mar. 10, 1986

[30] Foreign Application Priority Data

Mar. 16, 1985 [DE] Fed. Rep. of Germany ..... 3509521

[51] Int. Cl.[4] ..... F23D 14/46

[52] U.S. Cl. ..... 431/350; 60/749; 432/222

[58] Field of Search ..... 431/171, 350, 351; 60/749; 432/222; 239/432, 518

[56] References Cited

U.S. PATENT DOCUMENTS

| | | | |
|---|---|---|---|
| 2,193,176 | 3/1940 | Krugler et al. | 431/350 |
| 3,051,464 | 8/1962 | Yeo et al. | 431/351 |
| 3,177,923 | 4/1965 | Hine et al. | 431/350 |
| 3,178,161 | 4/1965 | Yeo et al. | 431/351 |
| 3,494,712 | 2/1970 | Vosper et al. | 431/171 |
| 3,544,255 | 12/1970 | Roper | 431/350 |
| 3,574,507 | 4/1971 | Kydd | 431/350 |
| 3,732,059 | 5/1973 | Goodnight et al. | 431/350 X |
| 3,843,309 | 10/1974 | Lambiris | 431/350 X |
| 4,462,795 | 7/1984 | Vosper et al. | 431/350 X |

*Primary Examiner*—Margaret A. Focarino
*Attorney, Agent, or Firm*—Kurt Kelman

[57] ABSTRACT

An atmospheric gas burner assembly comprises a burner tube defining a multiplicity of gas outlet ports and an element reducing the flame temperature and, hence, the emission of oxides of nitrogen disposed above the burner tube in the flame area. To optimize the reduction of $NO_x$ emission without affecting permitted CO values and to render the values of reduction in $NO_x$ emissions largely independent of the geometry of the surrounding combustion chamber so as to obtain reproducible emission reduction values, the reducing element is constituted by a multiplicity of fins confining the flames in shafts extending therebetween, the fins extending perpendicularly above the tube and being distributed along the tube.

14 Claims, 8 Drawing Figures

ATMOSPHERIC GAS BURNER ASSEMBLY

BACKGROUND OF THE INVENTION

1. Field of the Invention

The present invention relates to an atmospheric gas burner assembly comprising a burner tube defining a multiplicity of gas outlet ports producing flames in a flame area above the tube and an element reducing the flame temperature and, hence, emission of oxides of nitrogen disposed above the burner tube in the flame area.

2. Description of the Prior Art

Concerning the so-called $NO_x$ emission of heating systems operated by oil or gas burners, reference is made to "Gas-International", vol. 30 (1981), No. 1, pp. 41 and 42. General pollution problems have raised the question of $NO_x$ emission in heating systems, with efforts being made to reduce the $NO_x$ emission as far as possible. It has been suggested to protect the burner tubes, at the flame side thereof, by a fine mesh metal screen to thereby cool the flame and radiate away the heat absorbed by the element reducing the $NO_x$ formation. In respect of oil burners, the afore-mentioned article, among other things, contemplates a reducing element for this purpose, which is of a semi-spherical, perforated bowl configuration. It has been found especially with atmospheric gas burners that such inserts or flame baffles are capable of preventing the oxygen from the supplied secondary air from directly getting into contact with the peak flame temperature, thereby reducing the $NO_x$ formation. However, at the same time, it has been noted that in the event of an adverse influence of the element on the flame, the combustion reactions are affected thereby, causing enhanced CO formation; besides, this simple sort of protective baffles will not assure the maximum attainable $NO_x$ reduction which, presumably, is due to the fact that the flames are not adequately cooled. Presumably, this is also related to the geometry of the combustion chamber walls surrounding the burner tube, and to the geometry of the elements introduced into the peak flame areas and intended to reduce the $NO_x$ formation.

SUMMARY OF THE INVENTION

Consequently, it is an object of the invention to improve an atmospheric gas burner assembly of the aforementioned type to the effect that optimum values of $NO_x$ emission reduction are obtained and that such a reduction largely occur irrespective of the environmental geometry, i.e. the reduction in $NO_x$ emission be reproducible on substantially any boiler provided with an atmospheric gas burner assembly.

The above and other objects are obtained according to this invention with a reducing element constituted by a multiplicity of fins confining the flames in shafts extending therebetween, the fins extending perpendicularly above the tube and being distributed along the tube.

It has been found, quite amazingly, that the burner of the invention is capable of bringing about a substantially improved reduction in $NO_x$ emission which is largely attained irrespective of the corresponding surrounding geometry of the combustion chamber, with no rise in CO formation being noted. Basically, this can only be explained by the fact that the combustion reactions due to the specific shaping of the reducing element largely are left unaffected and that the elements in the form of fins comprise adequately large and heat dissipating surfaces which, in addition, are adequately cooled (equally due to the specific shaping), because parts of the secondary air can flow between the fins, since a sort of chimney-stack effect is created between the fins.

BRIEF DESCRIPTION OF THE DRAWING

The above and other features, objects and advantages of the invention will become more apparent from the following detailed description of certain now preferred embodiments thereof, taken in conjunction with the accompanying schematic drawing wherein.

DESCRIPTION OF PREFERRED EMBODIMENTS

Figure 1:
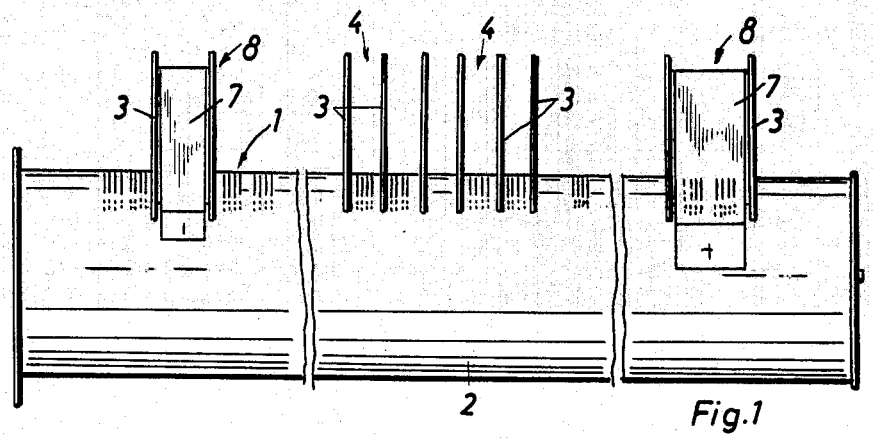
FIG. 1 shows a side view of a burner tube illustrating two embodiments of the reducing element.
Figure 2:
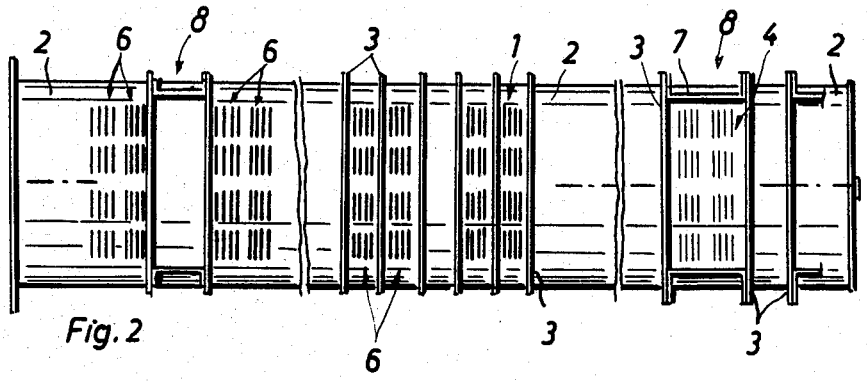
FIG. 2 shows a plan view of the burner tube.

Referring now to the drawing wherein like reference numerals designate like parts in all figures, FIGS. 1 and 2 illustrate an atmospheric gas burner assembly comprising burner tube 2 defining a multiplicity of gas outlet ports 1 producing flames in a flame area above the tube and an element reducing the flame temperature and, hence, emission of oxides of nitrogen ($NO_x$) disposed above the burner tube in the flame area. The reducing element is constituted by a multiplicity of fins 3 confining the flames in shafts 4 extending therebetween, the fins extending perpendicularly above the tube and being distributed along the tube.

While for the sake of a simplified illustration, FIGS. 1 and 2 show two different embodiments of the nitrogen oxides emission reducing element, in actual practice a single type of reducing element will be used in association with the burner tube. In the illustrated embodiments, gas outlet ports 1 are grouped in the flame area in arrays 6 extending transversely to the longitudinal axis of gas burner tube 2 and fins 3 are accordingly also disposed transversely to the tube axis. In the embodiment shown in the center of FIGS. 1 and 2, the pairs of fins 3 at each side of the arrays of gas outlet ports define flame shafts 4. The reducing element of the embodiment shown at the respective ends of the tube comprises side walls 7 extending between selected pairs of adjacent fins 3 to form shaft box 8 with the adjacent fins in at least one of the arrays of the gas outlet ports at the right end and between the arrays at the left end. The side walls forming shaft boxes between pairs of adjacent fins provide a reinforcement so that the fins are less subject to deformation caused by exposure to heat. Moreover, such shaft formation facilitates the mounting of the fins as compared to the arrangement of single fins shown in the center of FIGS. 1 and 2. The side walls may serve as mounting and holding elements for fins 3 and, as shown in FIG. 3, side walls 7 may define slots 15 at their ends for mounting the shaft boxes vertically adjustably with respect to tube 2 by means of stay bolts 16.

Figure 3:
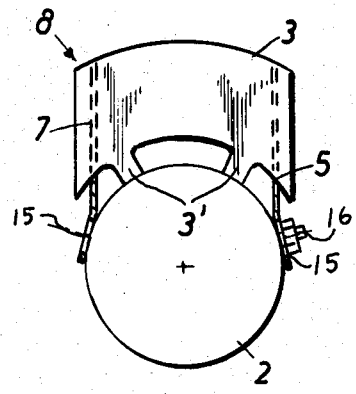
FIG. 3 is a front view of the burner tube of FIG. 1.

As shown in FIG. 3, fins 3 have bottom edges 5 spaced from the surface of burner tube 2 and shaped to conform to the surface of the tube transversely to the longitudinal axis thereof. If no other mounts, such as side walls 7, are provided for the fins, they may have small noses 3' providing spacers to define a desired distance between bottom edges 5 and the surface of the tube.

In the embodiment of the reducing element shown at the right end of gas burner tube 2, boxes 8 form the flame shafts while the flame shafts are formed between two boxes 8 in the embodiment shown at the left end of the tube, wherein each box is arranged between two arrays 6 of gas outlet ports. Irrespective of whether boxes 8 are disposed directly above an array 6 of gas outlet ports 1 or between two such arrays of ports, the fins of the boxes form flame shafts because, in the latter embodiment, two boxes are arranged in side-by-side relationship.

If desired, fins 3 could also be arranged parallel to the longitudinal axis of the tube, rather than transversely thereto, i.e. in series or in side-by-side relationship, with relatively short-length fin sections preferred to reduce the risk of heat deformation.

FIGS. 4 to 8 illustrate embodiments wherein selected pairs of adjacent fins 3 are arranged to form pocket-shaped bodies 9 open on the sides and on top. In the embodiments of FIGS. 4 to 7, gas outlet ports 1 are grouped in arrays and the pocket-shaped bodies are disposed above the tube in areas 12 free of the gas outlet ports since, as a rule, the burner ports are disposed in equidistantly spaced arrays 6. Pocket-shaped bodies 9 extend transversely to the longitudinal axis of gas burner tube 2 and have bottoms 10 forming a rounded transition zone connected to fins 3, the bottoms being shaped to conform to the surface configuration of the burner tube transversely to the tube (see FIG. 3) so that the bottom of the pocket-shaped body at all points is at the same distance from the surface of the tube. Such pocket-shaped bodies may readily be shaped from suitable metallic sheets with the aid of suitable forming tools in a single operating stage.

Figure 7:
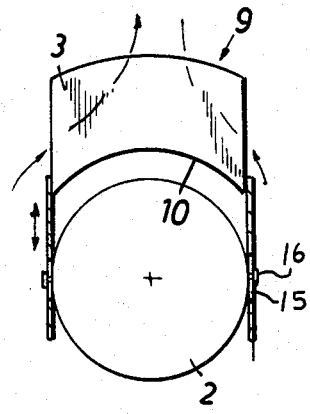
FIG. 7 is a view of the reducing element in the direction of arrow A of FIG. 6, as mounted on the burner tube.
Figure 4:
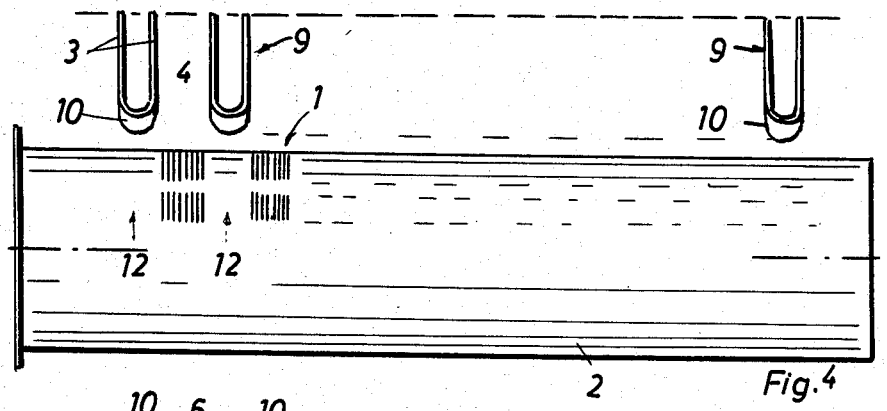
FIG. 4 is a side view of the burner tube showing another reducing element embodiment.
Figure 5:
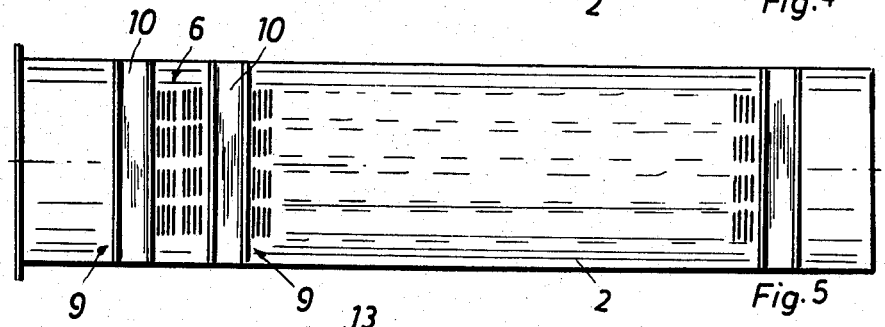
FIG. 5 is a plan view of the burner tube of FIG. 4.
Figure 6:
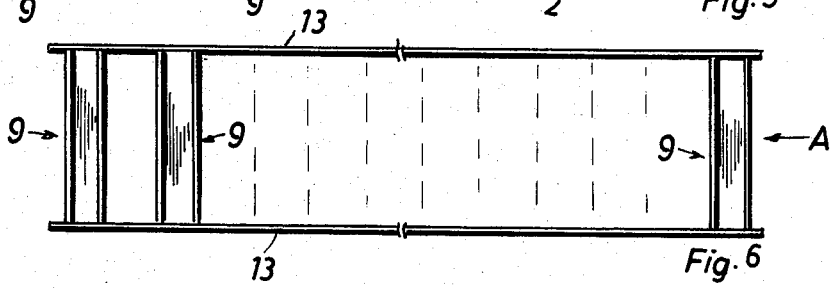
FIG. 6 is a plan view of the reducing element formed of the individual pocket-shaped bodies according to FIGS. 4 and 5.

Since at least about ten such pocket-shaped bodies 9 will have to be associated with each standard-length gas burner tube 2, it will be useful to form an assembly for mounting the pocket-shaped bodies on the tube, comprising a common carrier for the pocket-shaped bodies, such common carrier consisting of two lateral carriers 13, 13 for the fins, as shown in FIGS. 6 and 7. In a manner similar to that described in connection with FIG. 3, the carriers 13 may vertically adjustably mount the pocket-shaped bodies with respect to the tube by means of slots 15 engaged by bolts 16, with bottoms 10 thereof disposed at a predetermined distance above tube 2. If desired, pocket-shaped bodies 9 could also be mounted on the tube by carriers forming side walls for the bodies to constitute flame shafts similar to shafts 8 described hereinabove.

Mounting is preferably and advantageously performed so that the entire structure is adjustable to provide an optimum distance of the fins from the burner tube surface, taking into account the fact that the gases burned may be of different composition, which might require different distance adjustments of the reducing element relative to the burner tube to reduce the emission of nitrogen oxides to a maximum. When the pocket-shaped bodies are equidistantly spaced between arrays 6 of gas outlet ports 1, they will be subjected to a minimum of adverse effects. The flames will burn without impedance in the shafts defined between adjacent pocket-shaped bodies 9 which, in turn, are open for lateral ingress of secondary air (see flow arrows in FIG. 7), thereby cooling fins 7 so that they permanently withdraw heat from the peak flame area and this reduces $NO_x$ formation.

The fins may have a height not exceeding half the diameter of the tube.

Figure 8:
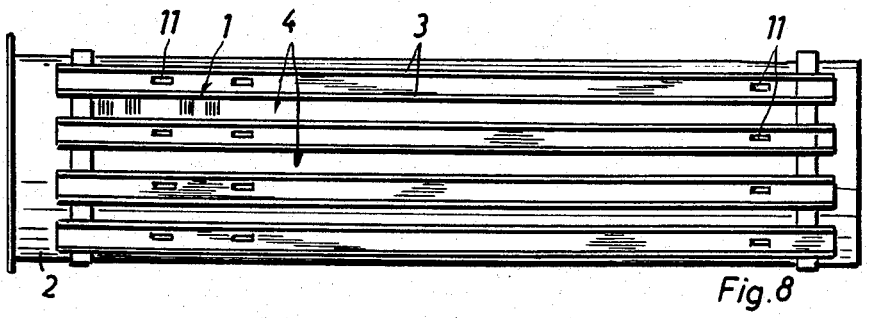
FIG. 8 is a plan view of the burner tube showing yet another embodiment of the reducing element.

As shown in FIG. 8, a plurality of pocket-shaped bodies extend in the longitudinal direction of the tube parallel to each other and have bottoms spaced equidistantly from the surface of the tube. While a multiplicity of short segments of such pocket-shaped bodies could be arranged in series along the length of the tube, this would require an enhanced mounting effort. In the illustrated embodiment, the bottoms of the pocket-shaped bodies define air inlet ports 11 and the spacing between the pocket-shaped bodies corresponds to their width. Slot-shaped ports 11 attain a chimney-stack cooling effect within pocket-shaped bodies 9 of the reducing element. Mounts 13 are suitably shaped so that the bottoms of all the pocket-shaped bodies have the same distance from the surface of the burner tube.

With respect to the above-described embodiments of the reducing element of the present invention, the gas outlet ports may be so arrayed in the gas burner tube that they suitably fit the shape and dimension of fins 3. These fins may be provided in the form of a coarse-screen grid of fins and, particularly if long fins are provided, such as in the embodiment of FIG. 8, it will be advisable to use material (such as thin ceramic) which is not, or only little, deformable.

What is claimed is:

1. An atmospheric gas burner assembly comprising a burner tube defining a multiplicity of gas outlet ports grouped in arrays extending along the length of the tube and producing flames in a flame area above the tube and an element reducing the flame temperature and, hence, emission of oxides of nitrogen disposed above the burner tube in the flame area, where the reducing element is constituted by a multiplicy of fins extending above the tube and being distributed along the tube, adjacent ones of the fins located at each side of the arrays of gas outlet ports to define flame shafts extending between the adjacent fins.

2. The atmospheric gas burner assembly of claim 1, wherein the fins have bottom edges spaced from the surface of the burner tube.

3. The atmospheric gas burner assembly of claim 1, wherein the fins have bottom edges shaped to conform to the surface configuration of the burner tube transversely to the tube.

4. The atmospheric gas burner assembly of claim 1, wherein side walls extend between selected pairs of the adjacent fins to form a shaft box with the adjacent fins confining at least one of the arrays of the gas outlet ports.

5. The atmospheric gas burner assembly of claim 1, wherein selected pairs of adjacent ones of the fins are arranged to form pocket-shaped bodies open on the sides and on top, and further comprising a common carrier for the pocket-shaped bodies.

6. The atmospheric gas burner assembly of claim 5, wherein a plurality of said pocket-shaped bodies extend in the longitudinal direction of the tube and have bottoms spaced eqidistantly from the surface of the tube.

7. The atmospheric gas burner assembly of claim 6, wherein the bottoms of the pocket-shaped bodies define air inlet ports.

8. The atmospheric gas burner assembly of claim 6, wherein the spacing between the pocket-shaped bodies corresponds to their width.

9. The atmospheric gas burner assembly of claim 5, wherein the gas outlet ports are grouped in arrays and the pocket-shaped bodies are disposed above the tube in areas free of the gas outlet ports.

10. The atmospheric gas burner assembly of claim 5, wherein the pocket-shaped body has a bottom shaped to conform to the surface configuration of the burner tube transversely to the tube.

11. The atmospheric gas burner assembly of claim 1, wherein the fins have a height not exceeding half the diameter of the tube.

12. The atmospheric gas burner assembly of claim 1, further comprising means for vertically adjustably mounting the fins on the burner tube.

13. The atmospheric gas burner assembly of claim 5, further comprising means for vertically adjustably mounting the carrier with the pocket-shaped bodies on the burner tube.

14. The atmospheric gas burner assembly of claim 1, wherein side walls extend between two pairs of the adjacent fins to form two shaft boxes with the adjacent fins of the respective pairs, the shaft boxes confining at least one of the arrays of the gas outlet ports therebetween.

* * * * *